US005689777A

United States Patent [19]

Yamamoto et al.

[11] Patent Number: 5,689,777

[45] Date of Patent: Nov. 18, 1997

[54] IMAGE FORMING APPARATUS HAVING CONTACT CHARGER

[75] Inventors: Masashi Yamamoto, Settsu; Hitoshi Saito, Mie-Ken; Koji Uno, Toyokawa, all of Japan

[73] Assignee: Minolta Co., Ltd., Osaka, Japan

[21] Appl. No.: 555,779

[22] Filed: Nov. 9, 1995

[30] Foreign Application Priority Data

Nov. 9, 1994 [JP] Japan ..... 6-274639

[51] Int. Cl.[6] ..... G03G 15/02

[52] U.S. Cl. ..... 399/174; 347/140; 399/50; 399/175; 361/221

[58] Field of Search ..... 355/219, 211, 355/210, 270; 361/212, 221, 225; 399/50, 168, 174, 175, 176; 347/140, 155

[56] References Cited

U.S. PATENT DOCUMENTS

| | | | |
|---|---|---|---|
| 5,148,219 | 9/1992 | Kohyama | 355/219 |
| 5,221,946 | 6/1993 | Kohyama | 355/270 |
| 5,305,177 | 4/1994 | Aoki et al. | 361/225 |
| 5,426,488 | 6/1995 | Hayakawa et al. | 355/219 |
| 5,440,374 | 8/1995 | Kisu | 355/219 |
| 5,444,519 | 8/1995 | Motoyama et al. | 399/50 |
| 5,512,982 | 4/1996 | Takahashi et al. | 355/219 |
| 5,561,502 | 10/1996 | Hirai et al. | 399/50 |
| 5,606,401 | 2/1997 | Yano | 399/175 |

FOREIGN PATENT DOCUMENTS 56-104346 8/1981 Japan .

*Primary Examiner*—Shuk Lee
*Attorney, Agent, or Firm*—Sidley & Austin

[57] ABSTRACT

An image forming apparatus includes a charging rotary brush in contact with a photosensitive member, a laser beam irradiator to form an electrostatic latent image, a developing unit for developing the latent image into a visible image and collecting residual developer remaining on the surface of the photosensitive member after the visual image is transferred to a transfer material, and a power source unit for applying to the charging rotary brush an oscillating voltage fulfilling the requirement of:

$$\Delta t < L/Vpc \text{ or } \Delta t > 3 \times L/Vpc$$

wherein Δt is the time taken for the oscillating voltage to vary between ±300 V above and below the central oscillating voltage value between the peaks of the voltage, L is the printing pitch, and Vpc is the speed of movement of the surface of the photosensitive member.

7 Claims, 4 Drawing Sheets

IMAGE FORMING APPARATUS HAVING CONTACT CHARGER

BACKGROUND OF THE INVENTION

1. Field of the Invention

The present invention relates to electrophotographic copying machines, printers and like image forming apparatus, and more particularly to image forming apparatus wherein a contact charger is used.

2. Description of the Related Art

Electrophotographic copying machines, printers or like image forming apparatus produce copy images generally by charging a photosensitive member by a charging unit, exposing the charged area to an optical image to form an electrostatic latent image, developing the latent image into a visible image, transferring the visible image to a sheet and fixing the image thereto.

To meet the demand that printers and like image forming apparatus incorporating a laser exposure unit or LED exposure unit be made more compact and less costly, various apparatus wherein the cleaner is dispensed with have been proposed in recent years.

For example, U.S. Pat. No. 5,148,219 and U.S. Pat. No. 5,221,946 disclose so-called cleanerless image forming apparatus which include a developing unit serviceable as a cleaner and wherein development and cleaning are effected at the same time. With this type of developing units, a developer support to which a developing bias voltage is applied usually develops an exposed area to form a visible image and also collects residual developer from an unexposed area after the transfer of the visible image to a sheet.

Further with such cleanerless image forming apparatus, the developer which is left untransferred remains on the surface of the photosensitive member after the transfer although in a small amount, so that when the image forming cycle is repeated, the residual developer resulting from the preceding cycle is charged and exposed to light, rendering the photosensitive member charged unevenly or blocking the exposure light to cause an eclipse phenomenon. The faulty portion then appears as a memory on the next image. With apparatus using the reversal developing process, a negative memory occurs due to an exposure eclipse or uneven charging.

In this connection, U.S. Pat. No. 5,148,219 and U.S. Pat. No. 5,221,946 mentioned above use a contact charging unit comprising a charging rotary brush, disclosing that the rotary brush, when rotated, charges the photosensitive drum and, at the same time, disturbs and disperses (nonpatternizes) the residual developer resulting from transfer, thereby precluding uneven charging and occurrence of memories.

U.S. Pat. No. 5,221,946 further discloses that a voltage comprising a d.c. component and an a.c. component superposed thereon is applied to the charging rotary brush, thereby disturbing and nonpatternizing the residual developer on the photosensitive drum and charging the drum at the same time to ensure charging of higher uniformity and effectively lessen image memories.

On the other hand, reproduction of more exquisite images of higher density is required of printers and like image forming apparatus year by year. For example, it is required for apparatus with a resolution of 300 dpi to satisfactorily print dotted half-tone images (formed by printing every other dot in both the main scanning direction and subscanning direction to a density of 25% in black-to-white ratio) as shown in FIG. 1 (A), or for apparatus with a resolution of 600 dpi to print satisfactory dotted half-tone images (formed by printing two dots every two dots to a density of 25% in black-to-white ratio) like the one shown in FIG. 1 (B).

However, with the apparatus adapted to prevent image memories by using a charging rotary brush for the charging unit and applying an oscillating voltage to the charging unit as stated above to thereby charge the photosensitive drum, and disturb and nonpatternize the residual developer as disclosed in U.S. Pat. No. 5,221,946, the dot pitch in the subscanning direction is likely to increase or decrease as shown in FIG. 2, with the result that noise in the form of lateral white streaks occurs in forming highly exquisite half-tone images like those mentioned above.

SUMMARY OF THE INVENTION

The main object of the present invention is to provide an image forming apparatus which is adapted to inhibit occurrence of image noise.

Another object of the invention is to provide an image forming apparatus which has a contact charging unit and in which a voltage containing an a.c. component is applied to the charging unit, the apparatus being adapted to inhibit occurrence of image noise in the form of white streaks while ensuring stabilized charging.

Still another object of the invention is to provide an image forming apparatus which includes a contact charging unit for charging a photosensitive member and is designed to develop the electrostatic latent image formed on the photosensitive member and clean this member of residual toner simultaneously with the development, and which is adapted to inhibit occurrence of white streaks even when forming dotted half-tone images while suppressing occurrence of memories due to the residual developer.

To achieve the above objects, the present invention provides an image forming apparatus comprising:

a photosensitive member, a contact charging unit having a charging rotary brush in contact with the photosensitive member, exposure means for exposing the photosensitive member to an image over an area thereof charged by the charging unit to form an electrostatic latent image, a developing unit for developing the latent image into a visible image and collecting residual developer remaining on the surface of the photosensitive member after the visual image is transferred to a transfer material, and a power source unit for applying to the charging unit an oscillating voltage fulfilling the requirement of:

$$\Delta t < L/Vpc \text{ or } \Delta t > 3 \times L/Vpc$$

wherein $\Delta t$ is the time taken for the oscillating voltage to vary between ±300 V above and below the central voltage value between the peaks of the voltage, L is the printing pitch and Vpc is the speed of movement of the surface of the photosensitive member.

To achieve the foregoing objects, the invention also provides an image forming apparatus comprising:

a photosensitive member, a contact charging unit having a charging rotary brush in contact with the photosensitive member, exposure means for exposing the photosensitive member to an image over an area thereof charged by the charging unit to form an electrostatic latent image, a developing unit for developing the latent image into a visible image and collecting residual developer remaining on the surface of the photosensitive member after the visual image is transferred to a transfer material, and a power source unit for applying to the charging unit an oscillating voltage fulfilling the requirements of:

$$\Delta t1<L/Vpc \text{ and } \Delta t2>3\times L/Vpc$$

wherein $\Delta t1$ is the time taken for the oscillating voltage to rise between ±300 V above and below the central voltage value between the peaks of the voltage, $\Delta t2$ is the time taken for the oscillating voltage to fall between ±300 V above and below the central voltage value between the peaks of the voltage, L is the printing pitch and Vpc is the speed of movement of the surface of the photosensitive member.

These and other objects, advantages and features of the invention will become apparent from the following description thereof taken in conjunction with the accompanying drawings with illustrated specific embodiments of the invention.

DETAILED DESCRIPTION OF THE PREFERRED EMBODIMENTS

Our investigation has indicated that the noise in the form of lateral white streaks described is attributable to the reason given below.

In the case where the photosensitive drum is charged and the residual developer is disturbed for nonpatternization by applying an oscillating voltage to the charging rotary brush, a force of electrostatic attraction acts or does not act between the drum surface and the rotary brush depending on the potential difference between the surface potential of the drum and the voltage applied to the charging brush. More specifically, attraction and release are repeated with a period corresponding to one-half of that of the oscillating voltage applied, consequently varying the torque of the drum to result in irregularities in the rotation of the drum. These rotational irregularities disturb the pitch of image exposure of the drum surface, producing noise in the form of lateral white streaks.

Figure 1A:
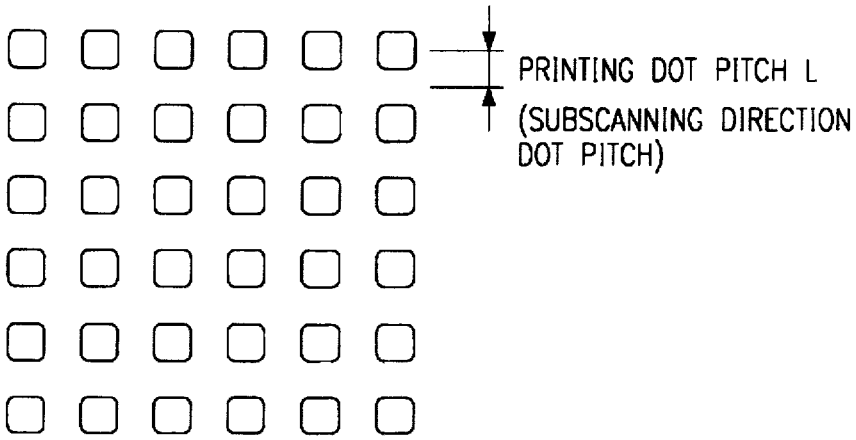
FIG. 1 shows two examples of dotted half-tone images, FIG. 1 (A) showing one of them obtained by an apparatus with a resolution of 300 dpi, FIG. 1 (B) showing the other image formed by an apparatus with a resolution of 600 dpi.
Figure 1B:
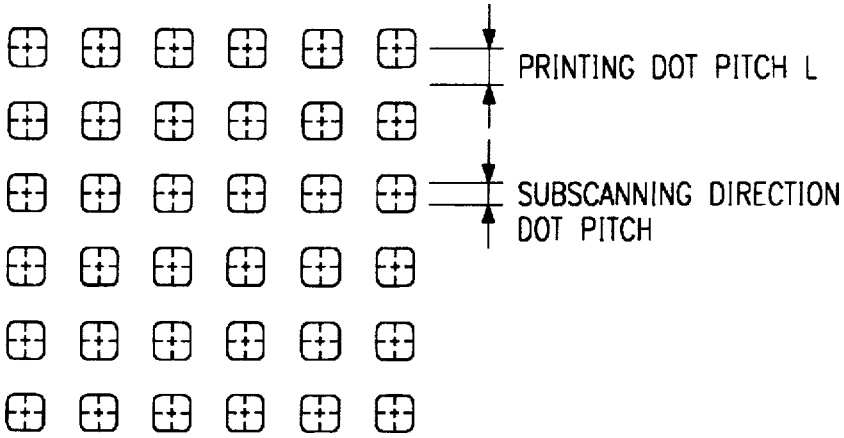
Figure 2:
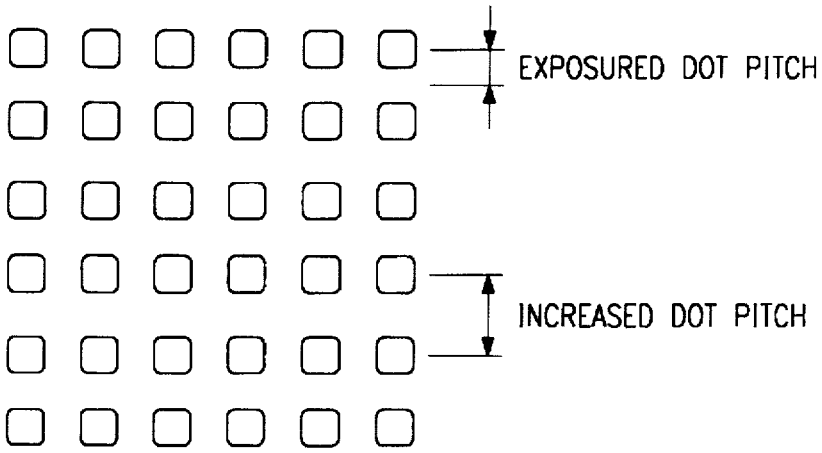
FIG. 2 is a diagram for illustrating irregularities in exposure pitch.
Figure 3:
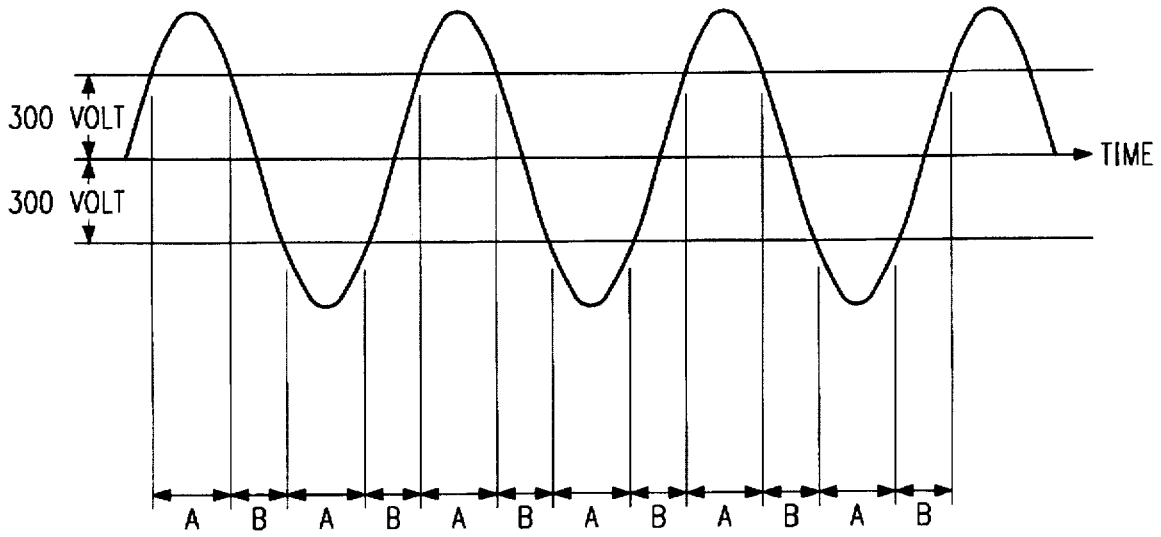
FIG. 3 is a diagram for illustrating the cause for variations in the speed of rotation of a photosensitive drum.

For example, when the sinusoidal a.c. voltage Vc shown in FIG. 3 is applied to the charging rotary brush, the force of electrostatic attraction acting between the drum and the brush varies depending on the difference |Vc−Vo| between the potential Vo on the drum surface and the potential Vc applied to the brush. With reference to FIG. 3, attraction repeatedly takes place in A sections of crests and troughs, and release in B sections of the transition from crest to trough and from trough to crest. Accordingly, when the drum and the brush are not the same in peripheral speed (as is usually the case) at the position where they are in contact, the frictional force acting on the drum circumferentially thereof repeatedly varies in magnitude, giving rise to variations in the torque of the drum and irregularities in its rotation.

Thus, irregularities occur in the rotational speed of the drum with half the period of the applied voltage, causing irregularities in the exposure pitch of the image forming apparatus. In the case of dotted half-tone images (25% in B/W ratio) or the like, such exposure pitch irregularities decrease or increase the dot pitch in the subscanning direction, with the result that the portion of increased dot pitch appears as if it were a white streak.

We have accordingly conducted repeated experiments and research and found the following two methods of eliminating the exposure pitch noise due to variations in the torque of the photosensitive member.

The first of these methods is to shorten the period of an decreased force of electrostatic attraction by reducing the time $\Delta t$ taken for the oscillating component of the applied voltage to change from plus to minus or from minus to plus beyond the central voltage value.

Figure 7:
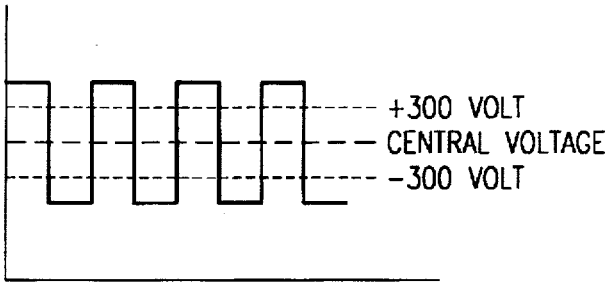
FIG. 7 is a diagram showing another example of oscillating voltage waveform (rectangular waveform)

More specifically stated, when the applied oscillating voltage has, for example, the rectangular waveform shown in FIG. 7, $\Delta t=0$, so that there is no period of attenuated force of electrostatic attraction, hence substantially no variation in the torque of the photosensitive member and no irregularities in the speed of rotation.

Assuming that the printing pitch of the image forming apparatus in the subscanning direction is L (mm) and that the system velocity (speed of movement of the surface of the photosensitive member) is Vpc (mm/sec), we have found that the exposure pitch noise can be substantially precluded if the following requirement is fulfilled.

$$\Delta t<L/Vpc \quad (1)$$

Various waveforms are usable when this requirement is met.

According to our experiments, no noise of white streaks arises from the application to the charging brush of a sinusoidal voltage which is 50 Hz in frequency and ±300 V with respect to the central voltage value, slight noise of white streaks from the application of a sinusoidal voltage of ±400 V with respect to the central voltage value, and conspicuous noise from the application of a sinusoidal voltage of ±500 V. Accordingly, $\Delta t$ in the above expression is defined as the time taken for the voltage to vary between ±300 V above and below the central voltage value between the maximum voltage value and the minimum voltage value.

The second method is to diminish the displacement per printing pitch by reducing the rate of variation of the electrostatic attracting force and thereby decreasing the variations in the torque of the photosensitive member.

Thus, this method intends to make Δt sufficiently great, contrary to the-first method. We have found that when the requirement of:

$$\Delta t > 3 \times L/Vpc \quad (2)$$

is fulfilled in this case, great variations in the torque of the photosensitive member are avoidable to diminish irregularities in the speed of rotation of the member, consequently precluding the exposure pitch noise substantially.

Incidentally, Δt can be increased, for example, by lowering the frequency of the oscillating voltage, but too low a frequency entails uneven charging, so that the frequency is preferably at least 30 Hz.

Figure 8:
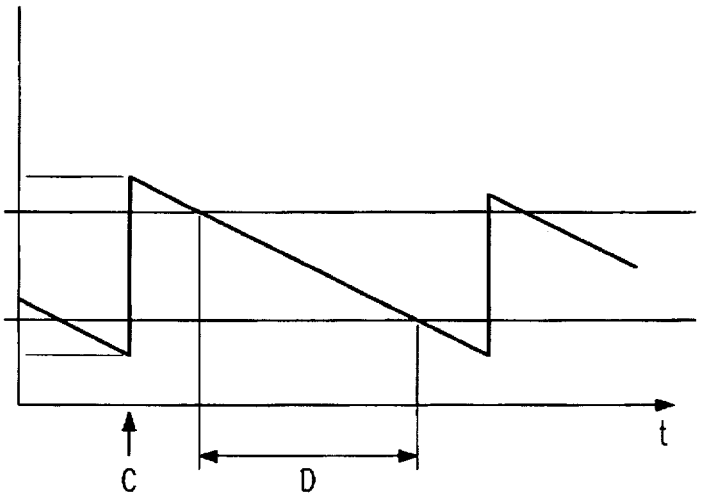
FIG. 8 is a diagram showing another example of oscillating voltage waveform (sawtooth waveform)
Figure 9A:
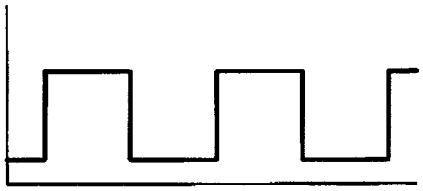
FIGS. 9 (A), 9(B), 9(C), 9(D), 9(E), 9(F), 9(G) and 9(H) are diagrams showing other examples of oscillating voltage waveforms.
Figure 9B:
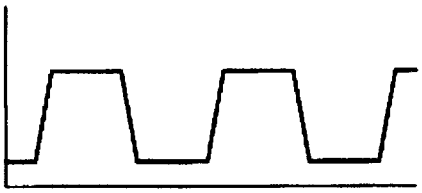
Figure 9C:
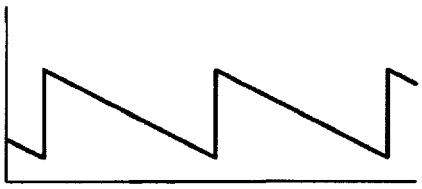
Figure 9D:
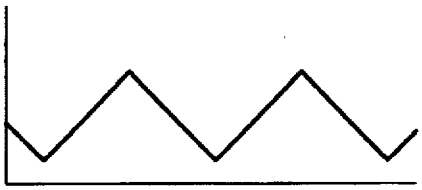
Figure 9E:
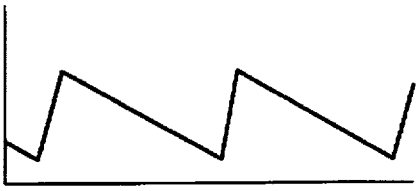
Figure 9F:
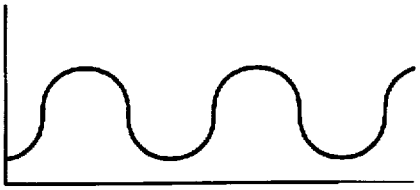
Figure 9G:
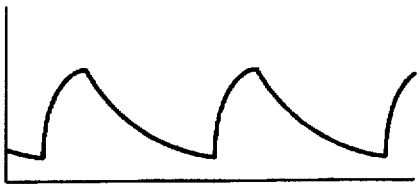
Figure 9H:
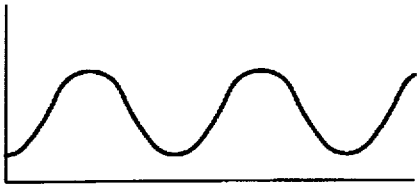

When the oscillating voltage to be applied has the sawtooth waveform shown in FIG. 8 as an example, Δt of the portion C shown is nearly 0, and Δt of the portion D is sufficiently great. The exposure pitch noise, can then be prevented at a suitable frequency.

We have also found that the exposure pitch noise can be precluded substantially by applying an oscillating voltage fulfilling the requirements of:

$$\Delta t1 < L/Vpc \text{ and } \Delta t2 > 3 \times L/Vpc$$

as a modification of the foregoing requirements. In the above expressions, Δt1 is the time taken for the oscillating voltage to rise between ±300 V above and below the central voltage value, between the peaks of the oscillating voltage, and Δt2 is the time taken for the oscillating voltage to fall between ±300 V above and below the central voltage value between the peaks of the oscillating voltage. Various oscillating voltage waveforms such as those shown in FIG. 9 can be used insofar as these requirements are fulfilled.

Figure 4:
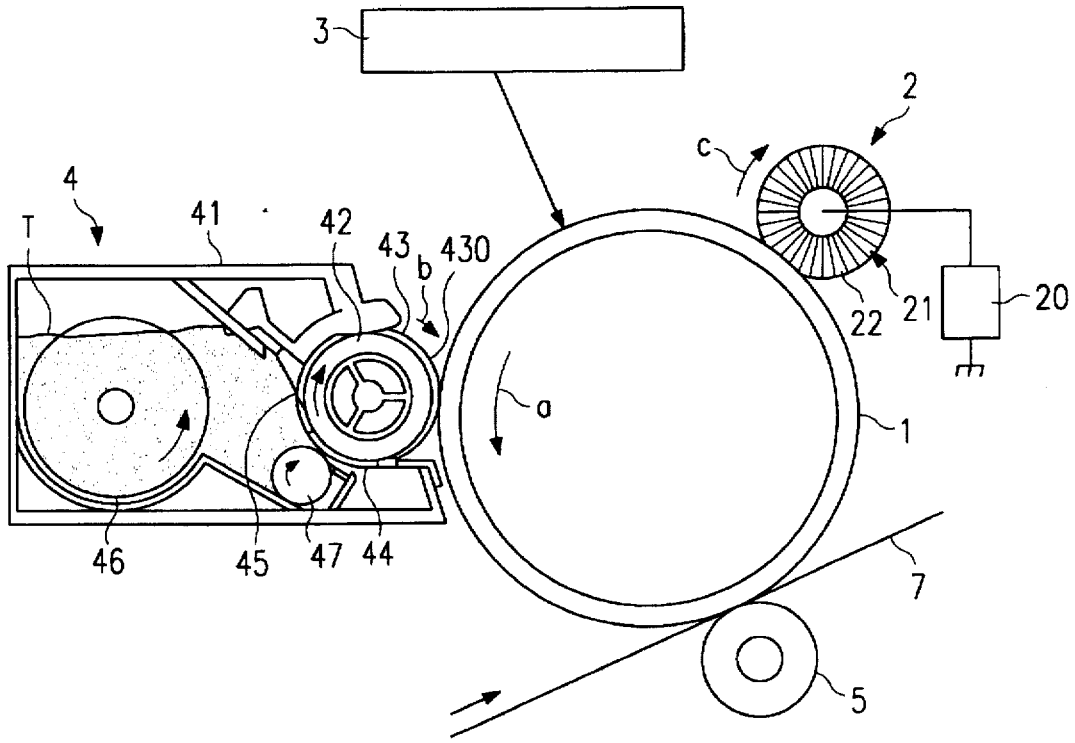
FIG. 4 is a diagram schematically showing the main arrangement of a printer as an embodiment of the invention.

An embodiment of the invention will be described below with reference to the drawings concerned. FIG. 4 schematically shows the construction of the main portion of the embodiment, i.e., a printer.

The printer has a photosensitive drum 1 in its center. The drum 1 is a negatively chargeable organic photosensitive member of the function separated type, having high sensitivity to light of long wavelength such as a semiconductor laser beam (780 nm in wavelength) or LED light (680 nm in wavelength). The drum 1 is drivingly rotated by an unillustrated drive device in the direction of arrow a shown (counterclockwise direction) at a system velocity (speed of movement of the drum surface) Vpc of 38 mm/sec.

A contact charging unit 2, developing unit 4, and roller transfer device 5 are arranged one after another around the drum 1. An image exposure unit 3 is disposed above the drum 1.

The charging unit 2 comprises a rotary brush 21 in contact with the surface of the drum 1 and having electrically conductive bristles 22 which are arranged radially around an electrically conductive shaft. The rotary brush 21 is drivingly rotated in the direction of arrow c opposite to the direction of rotation of the drum 1 at two to four times the peripheral speed Vpc of the drum, such that the bristles move in the same direction as the drum 1 when coming into contact therewith. A charging oscillating voltage is applied to the shaft of the rotary brush 21 from a power source unit 20 to charge the surface of the drum 1 uniformly to −800 (V).

Figure 5:
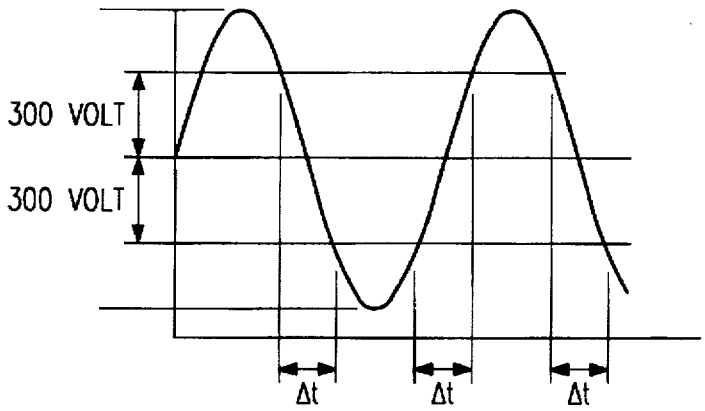
FIG. 5 is a diagram showing an example of oscillating voltage waveform (sinusoidal waveform) to be applied to a charging unit.

Stated more specifically, the power source unit 20, as used for Experimental Example 1 given later, was designed to apply to the charging unit 2 an oscillating voltage having the sinusoidal waveform of FIG. 5 and meeting the requirement of Δt<L/Vpc or Δt>3×L/Vpc wherein Δt is the time (sec) taken for the oscillating voltage to vary between ±300 V above and below the central voltage value between the peaks of the voltage, and L is the printing pitch (mm).

For use in Experimental Example 2 to be described later, the power source unit 20 was designed to apply to the charging unit 2 an oscillating voltage having the triangular waveform of FIG. 6 and meeting the requirements of Δt1<L/Vpc and Δt2>3×L/Vpc wherein Δt1 is the time (sec) taken for the oscillating voltage to rise between ±300 V above and below the central voltage value between the peaks of the voltage, Δt2 is the time (sec) taken for the oscillating voltage to fall between ±300 (V) above and below the central voltage value between the peaks of the voltage, and L is the printing pitch (mm).

The image exposure unit 3 comprises a semiconductor laser and a scanning laser beam reflecting polygon mirror which are generally known. The unit 3 in the present embodiment is so adjusted as to reduce the potential of the image area on the drum surface, as charged to −800 V, to about −50 V. The developing unit 4 is a unit using a monocomponent developer for reversal development, i.e., negatively chargeable toner T. The developing unit 4 comprises a drive roller 42 supported by a casing 61 and drivingly rotatable in the direction of arrow b shown (clockwise direction), a flexible developing sleeve 43 fitted around the roller 42 and having an inside diameter slightly larger than the outside diameter of the roller 42, and pressure belt members 44 pressing opposite ends of the sleeve 43 against the drive roller 42 from inside the casing 41 to form a slack portion 430 at the opposite side and to hold the slack portion in contact with the drum 1. Inside the casing 41, a regulating blade 45 of metal is pressed into contact with the developing sleeve 43.

The single-component developer, i.e., toner T, accommodated in the casing 41 is supplied to a toner transport roller 47 while being agitated by an agitator member 46 which is drivingly rotated counterclockwise in the drawing. The roller 47 moves the toner T toward the developing sleeve 43 while being drivingly rotated clockwise in the drawing. With the rotation of the drive roller 42, the developing sleeve 43 is driven in the same direction as the drive roller 42 by a frictional force acting between the sleeve 43 and the periphery of the roller 42, while the regulating blade 45 causes a specified amount of the toner T to adhere to the developing sleeve 43 while triboelectrifying the toner T. The sleeve 43 further feeds the toner T to the portion of the drum 1 in contact therewith by virtue of the rotation of the sleeve 43.

A developing bias voltage of −250 V is applied to the developing sleeve 43 from an unillustrated power source. The toner T can be adhered to the electrostatic latent image on the drum 1 by the bias voltage. On the other hand, the toner does not adhere to the drum 1 over the nonimage area owing to an electric field set up by the surface potential of the drum 1 and the developing bias voltage.

With the printer described above, the surface of the photosensitive drum 1 which is drivingly rotated is uniformly charged by the charging unit 2 to a surface potential of −800 V, and the charged area is exposed to an image by the exposure unit 3 to form an electrostatic latent image. The surface potential of the exposed area drops to about −50 V. The latent image thus formed is developed into a toner image by the developing unit 4 at a developing bias voltage of −250 V. For the development, the toner T on the developing sleeve 43 adheres to the latent image with a potential difference ΔV of 200 V.

The toner image formed in this way is transferred by the roller transfer device 5 to paper 7 sent forward from an unillustrated paper feeder, and the paper 7 bearing the transferred image is separated from the drum 1 and transported to an unillustrated fixing unit, by which the toner image is fixed to the paper. The resulting print is then discharged from the printer.

However, the toner on the drum 1 is not wholly transferred onto the paper 7 by the roller transfer device 5, but usually 10 to 20% of the toner remains on the drum 1 as residual toner. The residual toner is charged by the charging unit 2, is subjected to the step of exposure by the exposure unit 3 when required and reaches the developing unit 4 again, whereupon the residual toner is collected from the nonimage area by the developing sleeve 43 simultaneously when the toner on the sleeve 43 adheres to the image area.

In this case, the residual toner on the drum 1 is dispersed by the rotary brush 21 and thereby nonpatternized, whereby the surface of the drum 1 is uniformly charged. This diminishes the objection, such as exposure eclipse, to be subsequently encountered in the image exposure step.

At the position where the developing sleeve 43 is opposed to the drum 1, a force acting to move the residual toner toward the sleeve 43 is exerted by an electric field set up by the surface potential (−800 V, the drum 1 And the developing bias voltage (−250 V). The residual toner is caused to adhere to the developing sleeve 43 by the force of the electric field and a scraping force produced by the rubbing contact of the sleeve 43 with the drum surface, and is collected into the developing unit 4.

With the printer described, the oscillating voltage specified for application to the rotary brush 21 fulfills the requirement of $\Delta t<L/Vpc$ or $\Delta t>3\times L/Vpc$, or alternatively both the requirements of $\Delta t1<L/Vpc$ and $\Delta t2>3\times L/Vpc$. The specified voltage precludes or fully inhibits occurrence of image noise in the form of white streaks when dotted half-tone images are formed, while suppressing occurrence of memories due to the residual toner, whereby images can be formed with a correspondingly improved quality.

Now, Experimental Example 1 is given below wherein prints were produced by applying to the charging unit 2 an oscillating voltage having a sinusoidal waveform like the one shown in FIG. 5, 1 kV in peak-to-peak voltage value, −800 V in central voltage value) at varying frequencies and varying At values. The print images were dotted half-tone images (formed by printing every other dot in both the main scanning direction and the subscanning direction to a density of 25% in B/W ratio), 300 dpi, printing pitch=0.08467 mm, hence L/Vpc=0.002228 (sec).

For the evaluation of print images, the image was visually checked for noise in the form of lateral white streaks occurring owing to an increase in dot pitch in the subscanning direction, according to the following criteria.

○: good image of uniform density, free from visible lateral white streaks.

Δ: image with very slight lateral white streaks.

×: faulty image with numerous manifest lateral white streaks.

Experimental Example 1

| Frequency (Hz) | Image | Value of Δt (sec) | Note |
|---|---|---|---|
| 30 | ○ | 0.006828 | |
| 40 | Δ | 0.005121 | |
| 50 | X | 0.004097 | |
| 60 | X | 0.003414 | |
| 70 | X | 0.002926 | |
| 80 | X | 0.002560 | |
| 90 | Δ | 0.002286 | |
| 100 | ○ | 0.002048 | |
| 150 | ○ | 0.001366 | |
| 200 | ○ | 0.001024 | |
| 300 | ○ | 0.000683 | AC noise |
| 500 | ○ | 0.000410 | ↑ |
| 800 | ○ | 0.000256 | ↑ |

The results of Experimental Example 1 reveal that satisfactory images are obtained when the oscillating voltage applied has a frequency of 30 Hz (region of $\Delta t>3\times L/Vpc$) and at least 100 Hz (region of $\Delta t<L/Vpc$). When the frequency was not lower than 300 Hz, an a.c. sound (AC noise) was perceived.

Next, based on the results of Experimental Example 1, prints were prepared in the same manner as in Experimental Example 2 by applying to the charging unit an oscillating voltage at varying peak-to-peak voltage values Vp-p (V) and varying frequencies f (Hz), and the images were evaluated similarly as Experimental Example 2. Table 1 shows the results.

TABLE 1

| | FREQUENCY f (Hz) | | | | | | | | | | | | |
|---|---|---|---|---|---|---|---|---|---|---|---|---|---|
| Vp-p (V) | 30 | 40 | 50 | 60 | 70 | 80 | 90 | 100 | 150 | 200 | 300 | 500 | 800 |
| 700 | ○ | ○ | Δ | Δ | X | X | X | X | ○ | ○ | ○ | ○ | ○ |
| 800 | ○ | ○ | X | X | X | X | X | X | ○ | ○ | ○ | ○ | ○ |
| 900 | ○ | X | X | X | X | X | X | Δ | ○ | ○ | ○ | ○ | ○ |
| 1000 | ○ | X | X | X | X | X | Δ | ○ | ○ | ○ | ○ | ○ | ○ |
| 1100 | Δ | X | X | X | X | Δ | ○ | ○ | ○ | ○ | ○ | ○ | ○ |
| 1200 | X | X | X | X | Δ | ○ | ○ | ○ | ○ | ○ | ○ | ○ | ○ |
| 1300 | X | X | X | X | ○ | ○ | ○ | ○ | ○ | ○ | ○ | ○ | ○ |
| 1400 | X | X | X | Δ | ○ | ○ | ○ | ○ | ○ | ○ | ○ | ○ | ○ |

Table 2 shows the values of Δt involved in Experimental Example 2 when the frequency f (Hz) and the voltage value Vp-p (V) were altered variously.

TABLE 2

| Vp-p(V) | FREQUENCY f (Hz) 30 | 40 | 50 | 60 | 70 | 80 | 90 |
|---|---|---|---|---|---|---|---|
| 700 | 0.010925 | 0.008194 | 0.006555 | 0.005463 | 0.004682 | 0.004097 | 0.003642 |
| 800 | 0.008998 | 0.006749 | 0.005399 | 0.004499 | 0.003856 | 0.003374 | 0.002999 |
| 900 | 0.007743 | 0.005807 | 0.004646 | 0.003871 | 0.003318 | 0.002903 | 0.002581 |
| 1000 | 0.006828 | 0.005121 | 0.004097 | 0.003414 | 0.002926 | 0.002560 | 0.002276 |
| 1100 | 0.006121 | 0.004591 | 0.003673 | 0.003061 | 0.002623 | 0.002296 | 0.002040 |
| 1200 | 0.005556 | 0.004167 | 0.003333 | 0.002778 | 0.002381 | 0.002083 | 0.001852 |
| 1300 | 0.005090 | 0.003818 | 0.003054 | 0.002545 | 0.002181 | 0.001909 | 0.001697 |
| 1400 | 0.004699 | 0.003525 | 0.002820 | 0.002350 | 0.002014 | 0.001762 | 0.001566 |

| Vp-p (V) | FREQUENCY f (Hz) 100 | 150 | 200 | 300 | 500 | 800 |
|---|---|---|---|---|---|---|
| 700 | 0.003278 | 0.002185 | 0.001639 | 0.001093 | 0.000656 | 0.000410 |
| 800 | 0.002699 | 0.001800 | 0.001350 | 0.000900 | 0.000540 | 0.000337 |
| 900 | 0.002323 | 0.001549 | 0.001161 | 0.000774 | 0.000465 | 0.000290 |
| 1000 | 0.002048 | 0.001366 | 0.001024 | 0.000683 | 0.000410 | 0.000256 |
| 1100 | 0.001836 | 0.001224 | 0.000918 | 0.000612 | 0.000367 | 0.000230 |
| 1200 | 0.001667 | 0.001111 | 0.000833 | 0.000556 | 0.000333 | 0.000208 |
| 1300 | 0.001527 | 0.001018 | 0.000764 | 0.000509 | 0.000305 | 0.000191 |
| 1400 | 0.001410 | 0.000940 | 0.000705 | 0.000470 | 0.000282 | 0.000176 |

As previously stated,

L/Vpc=0.002228 (sec), 3×L/Vpc=0.006684 It therefore follows that satisfactory images are obtained when the relationship of:

$$\Delta t < L/Vpc \quad (1)$$

or $$\Delta t > 3 \times L/Vpc \quad (2)$$

is satisfied.

Assuming that the frequency is f (Hz) and the peak-to-peak voltage value is Vp-p (V) in the case of the sinusoidal waveform, $$\Delta t = (1/\pi f) \cdot \arcsin (600/Vp\text{-}p)$$

so that the above relational expressions are expressed as:

$$(1/\pi f) \cdot \arcsin (600/Vp\text{-}p) < L/Vpc \quad (3)$$

or $$(1/\pi f) \cdot \arcsin (600/Vp\text{-}p) > 3 \times L/Vpc \quad (4)$$

Figure 6:
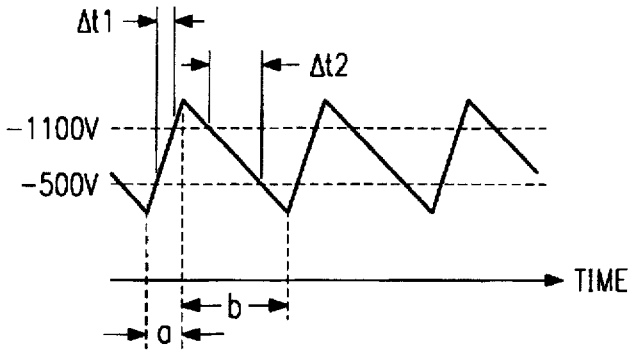
FIG. 6 is a diagram showing another example of oscillating voltage waveform (triangular waveform) to be applied to the charging unit.

Experimental Example 3 is given next wherein prints were prepared by applying to the charging unit 2 an oscillating voltage having a triangular waveform like the one shown in FIG. 6, 1 kV in peak-to-peak voltage, −800 V in central voltage value and 50 (Hz) in frequency) at varying Δt1 values and varying 1t2 values. This example is the same as Experimental Example 1 with respect to the print images, L/Vpc=0.002228 (sec) and the method of evaluating the images.

Experimental Example 3

| Triangular wave form (a:b) | Image | Value of Δt1 (sec) | Value of Δt2 (sec) |
|---|---|---|---|
| 1:1 | X | 0.006000 | 0.006000 |
| 1:2 | X | 0.004000 | 0.008000 |
| 1:3 | X | 0.003000 | 0.009000 |
| 1:4 | X | 0.002400 | 0.009600 |
| 1:5 | ○ | 0.002000 | 0.010000 |
| 1:6 | ○ | 0.001714 | 0.010286 |
| 1:7 | ○ | 0.001500 | 0.010500 |
| 1:8 | ○ | 0.001333 | 0.010667 |
| 1:9 | ○ | 0.001200 | 0.010800 |
| 0:1 (Sawtooth) | ○ | About 0 | 0.012000 |

The experiment reveals that satisfactory images are obtained when the oscillating voltage applied fulfills the requirements of Δt1<L/Vpc and Δt2>3×L/Vpc.

In Experimental Examples 4 and 5 to follow, prints were prepared by applying to the charging unit 2 an oscillating voltage having the rectangular waveform of FIG. 7 (Example 4) or an oscillating voltage having the sawtooth waveform of FIG. 8 (Example 5) 1 kV in peak-to-peak voltage, −800 V in central voltage value) at different frequencies of 50 Hz, 70 Hz and 100 Hz. These examples are the same as Experimental Example 1 with respect to the print images, L/Vpc =0.002228 (sec) and the method of evaluating the images.

| Frequency (Hz) | Image | Value of Δt1 (sec) | Value of Δt2 (sec) |
|---|---|---|---|
| Experimental Example 4 | | | |
| 50 | ○ | 0.000000 | 0.000000 |
| 70 | ○ | 0.000000 | 0.000000 |
| 100 | ○ | 0.000000 | 0.000000 |

-continued

| Frequency (Hz) | Image | Value of Δt1 (sec) | Value of Δt2 (sec) |
|---|---|---|---|
| | Experimental Example 5 | | |
| 50 | ○ | 0.000000 | 0.012000 |
| 70 | ○ | 0.000000 | 0.008571 |
| 100 | X | 0.000000 | 0.006000 |

The photosensitive member for use in the image forming apparatus of the present invention is not limited to the drum type but may be in the form of an endless belt. The charging brush is not limited to the rotary type either; the invention is applicable also to image forming apparatus wherein a fixed charging brush is used.

Further from the viewpoint of cost reductions, it is desirable to use a power source of low frequency. Power sources of low cost are usable when the frequency range is about 30 to about 800 Hz.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a photosensitive member;

a contact charging unit having a charging rotary brush in contact with a surface of the photosensitive member;

exposure means for exposing the surface of the photosensitive member to an image over an area thereof, charged by the charging unit, to form an electrostatic latent image;

a developing unit for developing the latent image into a visible image and collecting residual developer remaining on the surface of the photosensitive member after the visual image is transferred to a transfer material; and a power source unit for applying to the charging unit an oscillating voltage fulfilling the requirement of:

$$\Delta t < L/Vpc \text{ or } \Delta t > 3 \times L/Vpc$$

wherein said oscillating voltage has a plurality of peaks and a central voltage value, wherein Δt is a time taken for the oscillating voltage to vary between ±300 V above and below the central voltage value between the peaks of the oscillating voltage, L is a printing pitch, and Vpc is a speed of movement of the surface of the photosensitive member.

2. An image forming apparatus as claimed in claim 1, wherein said charging rotary brush of the contact charging unit has electrically conductive bristles which are arranged radially around an electrically conductive shaft.

3. An image forming apparatus as claimed in claim 2, wherein said charging rotary brush of the contact charging unit is rotated in a direction opposite to a direction of rotation of the photosensitive member at a peripheral speed which is two to four times a peripheral speed of the photosensitive member.

4. An image forming apparatus as claimed in claim 1, wherein said oscillating voltage has a sinusoidal waveform.

5. An image forming apparatus as claimed in claim 4, wherein said oscillating voltage has a frequency which is in the range of about 30–800 Hz.

6. An image forming apparatus comprising:

a photosensitive member;

a contact charging unit having a charging rotary brush in contact with a surface of the photosensitive member;

exposure means for exposing the surface of the photosensitive member to an image over an area thereof, charged by the charging unit, to form an electrostatic latent image;

a developing unit for developing the latent image into a visible image and collecting residual developer remaining on the surface of the photosensitive member after the visual image is transferred to a transfer material; and a power source unit for applying to the charging unit an oscillating voltage fulfilling the requirement of:

$$\Delta t1 < L/Vpc \text{ and } \Delta t2 > 3 \times L/Vpc$$

wherein said oscillating voltage has a plurality of peaks and a central voltage value, wherein Δt1 is a time taken for the oscillating voltage to vary between ±300 V above and below the central voltage value between the peaks of the oscillating voltage, Δt2 is a time taken for the oscillating voltage to fall between ±300 V above and below the central voltage value between the peaks of the oscillating voltage, L is a printing pitch, and Vpc is the speed of movement of the surface of the photosensitive member.

7. An image forming apparatus comprising:

a photosensitive member having a surface;

a contact charging unit having a charging rotary brush in contact with the surface of the photosensitive member;

exposure means for exposing the surface of the photosensitive member to an image over an area thereof, charged by the charging unit, to form an electrostatic latent image;

a developing unit for developing the latent image into a visible image and collecting residual developer remaining on the surface of the photosensitive member after the visual image is transferred to a transfer material; and a power source unit for applying to the charging unit an oscillating voltage having a frequency and a sinusoidal waveform fulfilling the requirement of:

$$(1/\pi f)\cdot\arcsin(600/Vp\text{-}p) < L/Vpc$$

or $$(1/f)\cdot\arcsin(600/Vp\text{-}p) > 3 \times L/Vpc$$

wherein f is the frequency of the oscillating voltage, Vp-p is a peak-to-peak voltage of the oscillating voltage, L is a printing pitch, and Vpc is a speed of movement of the surface of the photosensitive member.

* * * * *

UNITED STATES PATENT AND TRADEMARK OFFICE

CERTIFICATE OF CORRECTION

PATENT NO. : 5,689,777

DATED : November 18, 1997

INVENTOR(S) : Masashi Yamamoto, et al.

It is certified that error appears in the above-indentified patent and that said Letters Patent is hereby corrected as shown below:

Column 12, line 58, delete "(1/f)•arcsin(600/Vp-p) > 3xL/Vpc" and insert --(1/πf)•arcsin(600/Vp-p) > 3xL/Vpc--.

Signed and Sealed this

Fourteenth Day of July, 1998

Bruce Lehman

*Attest:*

BRUCE LEHMAN

*Attesting Officer*

*Commissioner of Patents and Trademarks*